US009655794B2

(12) United States Patent
Bednarz, III et al.

(10) Patent No.: US 9,655,794 B2
(45) Date of Patent: May 23, 2017

(54) ADJUSTABLE WHEELCHAIR

(71) Applicants: Edward T. Bednarz, III, Dunmore, PA (US); Heather Bednarz, Dunmore, PA (US); Ryan Murphy, Noxen, PA (US); Justin Sekula, Towanda, PA (US); Mark Willchock, Hallstead, PA (US); Tyler J. Brown, Sellersville, PA (US)

(72) Inventors: Edward T. Bednarz, III, Dunmore, PA (US); Heather Bednarz, Dunmore, PA (US); Ryan Murphy, Noxen, PA (US); Justin Sekula, Towanda, PA (US); Mark Willchock, Hallstead, PA (US); Tyler J. Brown, Sellersville, PA (US)

( * ) Notice: Subject to any disclaimer, the term of this patent is extended or adjusted under 35 U.S.C. 154(b) by 0 days.

(21) Appl. No.: 14/876,878

(22) Filed: Oct. 7, 2015

(65) Prior Publication Data

US 2017/0100291 A1 Apr. 13, 2017

(51) Int. Cl.

| | |
|---|---|
| ***A61G 5/08*** | (2006.01) |
| ***A61G 5/10*** | (2006.01) |
| *A61G 5/12* | (2006.01) |

(52) U.S. Cl.

CPC ..... *A61G 5/08* (2013.01); *A61G 5/1062* (2013.01); *A61G 2005/0825* (2013.01); *A61G 2005/122* (2013.01); *A61G 2005/124* (2013.01)

(58) Field of Classification Search

CPC ..... A61G 5/08; A61G 2005/0808; A61G 2005/0816; A61G 2005/0825; A61G 2005/0841; A61G 2005/0858; A61G 2005/0833; A61G 2005/0875; A61G 2005/0883; A61G 2005/122; A61G 2005/124; A61G 5/1062

See application file for complete search history.

(56) References Cited

U.S. PATENT DOCUMENTS 3,887,228 A * 6/1975 Ingerson ..... A61G 5/08 16/29
3,937,490 A * 2/1976 Nasr ..... A61G 5/1059 280/250.1

(Continued)

FOREIGN PATENT DOCUMENTS

EP 1762210 A1 * 3/2007
JP 2004159950 A * 6/2004

*Primary Examiner* — Hau Phan
*Assistant Examiner* — Jacob Meyer
(74) *Attorney, Agent, or Firm* — Zale Patent Law, Inc.; Lawrence P. Zale

(57) ABSTRACT

An adjustable wheelchair is disclosed which adjusts to changes in a user's size and weight which includes a scissor-type foldable mechanism which connects two side frames. Wheels for the wheelchair are attached to each of the side frames. An adjustable seat and adjustable back support are a flexible material which span from one side frame to the other. These are designed to unroll and lengthen or roll up and shorten the width of the seat and the back support between the side frames. The scissor-type foldable mechanism includes a tube which slides within a tube, a threaded rod and a threaded stop which function to allow pre-adjustment of the width of the foldable mechanism such that it may be folded and opened to the pre-adjusted width. The frames may be supplemented with reinforcements to accommodate a change in the user's weight.

13 Claims, 12 Drawing Sheets

(56) References Cited

U.S. PATENT DOCUMENTS 4,045,051 A * 8/1977 Igarashi ..... A61G 5/08 280/42
4,082,348 A 4/1978 Haury
4,730,842 A * 3/1988 Summers ..... A61G 5/00 280/42
4,741,547 A * 5/1988 Tholkes ..... A61G 5/08 280/250.1
4,813,693 A * 3/1989 Lockard ..... A61G 5/00 280/304.1
4,989,890 A * 2/1991 Lockard ..... A61G 5/00 280/250.1
5,253,886 A * 10/1993 Weege ..... A61G 5/08 280/39
5,607,202 A * 3/1997 Toso ..... A61G 5/08 297/350
5,758,897 A * 6/1998 Kueschall ..... A61G 5/08 280/250.1
5,782,483 A * 7/1998 Rogers ..... A61G 5/08 280/250.1
5,984,418 A * 11/1999 McInturff ..... A61G 5/1062 248/298.1
5,996,716 A * 12/1999 Montiglio ..... A61G 5/045 180/6.5
6,135,475 A * 10/2000 Brown ..... A61G 5/08 280/250.1
6,164,674 A * 12/2000 Rogers ..... A61G 5/08 280/250.1
6,352,307 B1 * 3/2002 Engman ..... A61G 5/1059 297/284.1
6,467,788 B1 * 10/2002 Li ..... A61G 5/08 280/304.1
6,499,762 B1 * 12/2002 Rogers ..... A61G 5/08 280/250.1
6,572,133 B1 * 6/2003 Stevens ..... A61G 5/08 280/250.1
6,932,369 B2 * 8/2005 Walsh ..... A61G 5/08 280/250.1
7,077,422 B2 * 7/2006 Haury ..... A61G 5/08 280/644
7,246,821 B2 * 7/2007 Sato ..... A61G 5/08 280/793
7,404,567 B2 * 7/2008 Moller ..... A61G 5/00 280/250.1
7,472,921 B2 * 1/2009 Harrison ..... A47C 4/286 280/647
7,988,171 B2 * 8/2011 Chong ..... A61G 5/08 280/250.1
8,454,048 B1 * 6/2013 Regan ..... A61G 5/08 280/646
8,628,108 B2 * 1/2014 Gingras ..... A61G 5/08 280/42
8,641,078 B2 * 2/2014 Yang ..... A61G 5/08 280/647
9,259,370 B2 * 2/2016 Gabriely ..... A61G 5/00
9,375,370 B2 * 6/2016 Horacek ..... A61G 5/08
2002/0093156 A1 * 7/2002 Stevens ..... A61G 5/08 280/42
2009/0194975 A1 * 8/2009 Harrison ..... A47C 4/286 280/649
2012/0126513 A1 * 5/2012 Kent ..... A61G 5/08 280/650
2013/0257009 A1 * 10/2013 Rogers ..... A61G 5/08 280/250.1
2015/0245963 A1 * 9/2015 Lauret ..... A61G 5/08 280/650
2015/0250667 A1 * 9/2015 Thompson ..... A61G 5/08 280/650
2016/0270989 A1 * 9/2016 Yentzer ..... A61G 5/02

* cited by examiner

ADJUSTABLE WHEELCHAIR

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

1. Field of Invention

The current invention relates to adjustable wheelchairs, and more specifically to adjustable wheelchairs that easily adjust to the differences in a user's size and weight over time.

2. Description of Related Art

Many people ("users") that have difficulty walking may require wheelchairs. Since some of these have chronic or degrading conditions, they may require a wheelchair for long periods of time, or even for the rest of their life.

Some of these users are children. If they are fitted for a wheelchair when they are small, they can quickly outgrow the wheelchair. Since insurance typically pays for the wheelchair, it is possible that the insurance company does not pay for another wheelchair, requiring the user to pay the bill. If the user chooses not to pay or is unable to pay for the replacement wheelchair, the user then is cramped into a wheelchair that is not the proper size.

In the alternative, a child user may be measured for a wheelchair, but given one that is several times larger than his/her measured size to compensate for growth. In this situation, the user now has to deal with a wheelchair that is higher, wider and heavier than the user needs.

Adult users may also require alternate positioning prior to the allotted time for a replacement wheelchair to be provided by insurance company. Due to changes in medical status, users may need larger or small wheelchairs throughout the disease process. However, most forms of insurance will only pay for a new mobility device once every five years. Therefore, adult users would also benefit from an adjustable wheelchair to meet their needs through the years.

Regardless of age, proper fitting wheelchairs are important to the safety and independence of users. If a wheelchair does not adequately meet the needs of the user, skin breakdown and other injuries may occur. A wheelchair that is too large may not provide adequate support to prevent falls from the wheelchair. Also, a wheelchair that is too small may cause pressure areas on users which could lead to skin breakdown and ultimately decreased independence due to new illnesses.

Since these users typically require the wheelchair almost everywhere they go, it must be transported with them. In order to easily transport the wheelchair, they are typically designed to be folded and fit into an automobile. They are also loaded into and taken out of cars, carried up steps, and across surfaces upon which they cannot travel. Therefore, the weight of the wheelchair is important. Since they are lifted many times a day, any weight reduction is multiplied by the number of times it is lifted and results in a significant energy savings over the course of the day.

Therefore, a chair larger than required results in a heavier wheelchair and a significant waste of energy lifting the wheelchair throughout the day.

In the alternative, if a properly sized wheelchair is used for a child, as the child grows, the wheelchair is not only too small, but may lack the required structural support as the user gets heavier.

There have been attempts at making adjustable wheelchairs.

U.S. Pat. No. 4,082,348, Apr. 4, 1978 Haury, and US Patent Application 2012/0126513 A1, May 24, 2012, Kent et al. describes an X-like configuration for an adjustable wheelchair. These employ cross members that have a tube which fits inside of another tube with holes at various locations. The tubes can be expanded so that the pins fit into the holes in the tubes at these fixed locations providing several fixed adjustment lengths to the size of the wheelchair. This does not provide adjustment to a given length, but only to the several pre-selected lengths which is used to approximate the proper desired width for the user. These also involve the adjustment of several structures.

U.S. Pat. No. 4,989,890, Feb. 5, 1991 Lockard et al. has a similar structure and similar problems.

U.S. Pat. No. 5,782,483, Jul. 21, 1998, Rogers et al. al. and US Patent Application 2013/0257009 A1, Oct. 3, 2013, Rogers describe an x-like configuration that is continuously adjustable. This requires simultaneous adjustment of two sliders in order to prevent binding when adjusting it.

U.S. Pat. No. 6,467,788 B1 Oct. 22, 2002, Li et al. describes a folding design, but is not intended to be adjustable.

U.S. Pat. No. 8,454,048 B1 Jun. 4, 2013 Regan et al. describes another folding design that is not intended to be adjustable.

The above designs do not adjust to support more weight or adjust to become lighter.

Currently, there is a need for a wheelchair with a simple design that would adjust to accommodate changes in the size and weight of the user over time.

BRIEF DESCRIPTION OF THE DRAWINGS

The advantages of the current specification will become more apparent when read in connection with the drawings, wherein.

SUMMARY OF THE INVENTION

Figure 2:
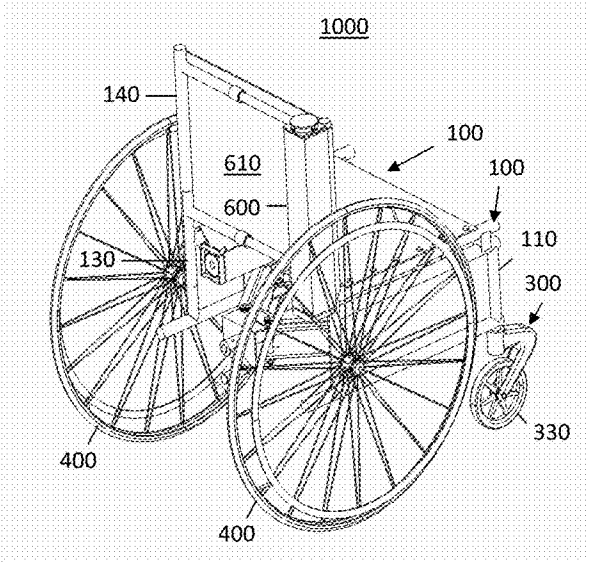
FIG. 2 is a perspective view, partially from the rear of an embodiment of an adjustable wheelchair according to the current invention.

The current invention may be embodied as an adjustable wheelchair with two side frames supporting at least one wheel. A foldable mechanism connects the first side frame to the second side frame. The foldable mechanism is continuously adjustable which can be placed in one of a collapsed position in which it has minimal width and an open position in which it opens to a pre-adjusted width. A back support is used that can be placed in one of a collapsed position in which it has minimal width and an open position in which it opens to the pre-adjusted width.

It also employs a seat support which can be placed in one of a collapsed position in which it has minimal width and an open position in which it opens to the pre-adjusted width. The seat support and back support may be implemented as cartridges that contain a roll of fabric or other material that may automatically adapt to the size of the user. The cartridges have a retracting mechanism which is similar to that of a conventional seat belt retraction mechanism.

In an alternative embodiment, the cartridges may be replaced with cartridges having wider or narrower fabric to adjust to back supports being longer from top to bottom and seats being longer from front to back.

The invention may also be embodied as an adjustable wheelchair having a first side frame supporting at least one wheel, a second side frame supporting at least one wheel, and a foldable mechanism connecting the first side frame to the second side frame. The foldable mechanism is continuously adjustable and can be placed in one of a collapsed position in which it has minimal width and an open position in which it opens to a pre-adjusted width. It also includes attachment devices on the foldable mechanism. Removable reinforcement members of various strengths are adapted to attach to the attachment devices to adjust the structural strength of the wheelchair to a user's current weight and as the user changes size and weight. The seat support and/or the back support may be in a cartridge form which includes a roller attached to a first side frame such that the roller can rotate, seat material wound around the roller having a free end attached to a second side frame, a spring biasing the roller to rotate in a direction to roll in the free end of the seat material, and a stop on the roller which stops rotation of the roller. The seat cartridge and back cartridge may be replaced with other cartridges having different sized seat materials/back materials to fit the current size of the user.

The current invention may also be embodied as a method of providing a wheelchair that adjusts to a user's changing size and weight, by providing a first and second side frame each having a front wheel and a rear wheel held together with an expandable diamond frame, fixing a seat cartridge adjacent one side frame that is adapted to provide a variable length of seat materials that has a free end, wherein the free end of the seat material is attached to one of the other side frame or a structure connected to the other side frame, and identifying when the size of the user is not the size that the wheelchair is adjusted to accommodate. When the user's size is not the same as the user size that the wheelchair is adjusted to accommodate, the diamond frame is adjusted to provide the correct width, and the seat cartridge is adjusted to provide the proper seat width. As indicated above, in an alternative embodiment, the cartridges may be replaced with those having different width material for either the seat or back support.

When the user's weight is not the same as the weight the wheelchair is adjusted to accommodate, then one may add reinforcement members and replace reinforcement members with reinforcement members of different strengths to result in the proper strength being used to accommodate the user's weight.

DETAILED DESCRIPTION OF A PREFERRED EMBODIMENT

The present invention will now be described in detail by describing various illustrative, non-limiting embodiments thereof, with reference to the accompanying drawings. The invention may, however, be embodied in many different forms and should not be construed as being limited to the illustrative embodiments set forth herein. Rather, the embodiments are provided so that this disclosure will be thorough and will fully convey the concept of the invention to those skilled in the art. The claims should be consulted to ascertain the true scope of the invention.

As indicated above, it is important to provide an adjustable wheelchair that has a continuous range of adjustment instead of several preselected adjustment widths.

This should be light and adjusts to a smaller size so that it is easy to transport. It should also be able to adjust to carry extra weight as the user gets heavier.

It is best if it can be folded for storage, but then be able to quickly open to the last adjustment size and be easy to use.

The current embodiment of the adjustable wheelchair 1000 according to the current invention will be described in connection with FIGS. 1-6.

Figure 1:
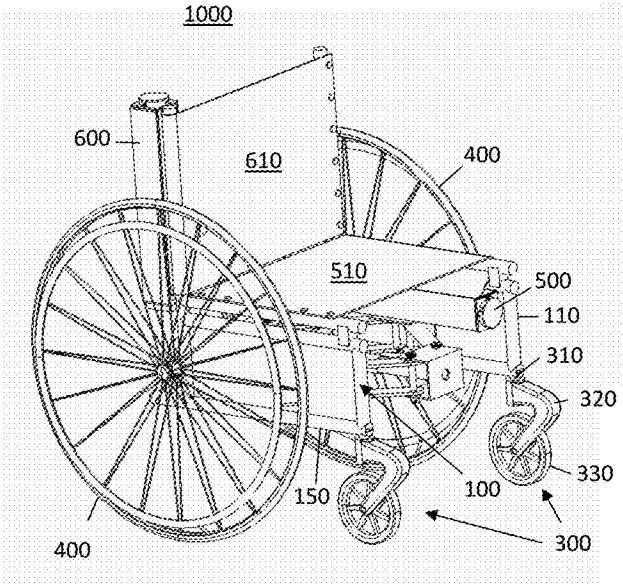
FIG. 1 is a perspective view, partially from the front of an embodiment of an adjustable wheelchair according to the current invention.

FIG. 1 is a perspective view, partially from the front of an embodiment of an adjustable wheelchair according to the current invention.

Figure 3:
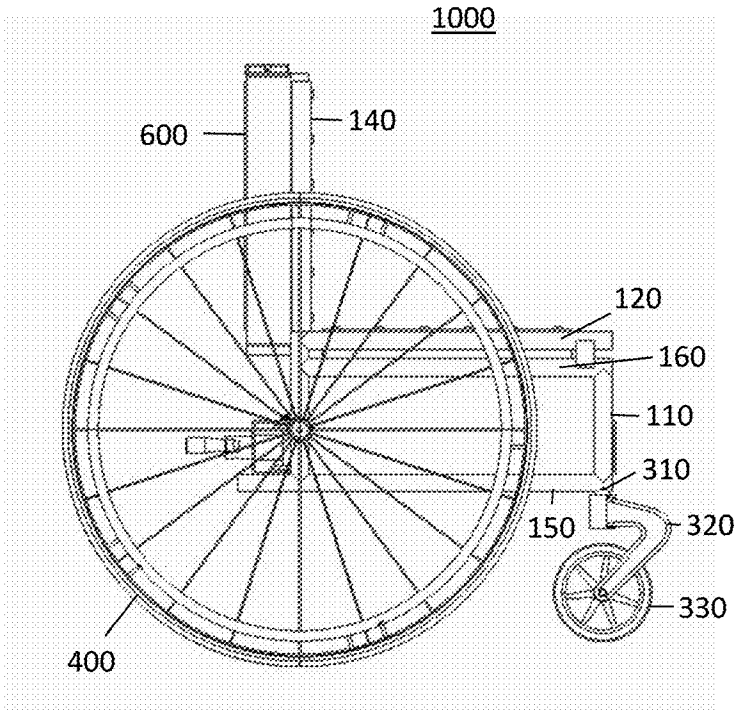
FIG. 3 is a side elevational view of the adjustable wheelchair of FIG. 1.

FIG. 2 is a perspective view, partially from the rear of an embodiment of an adjustable wheelchair according to the current invention FIG. 3 is a side elevational view of the adjustable wheelchair of FIG. 1.

Figure 4:
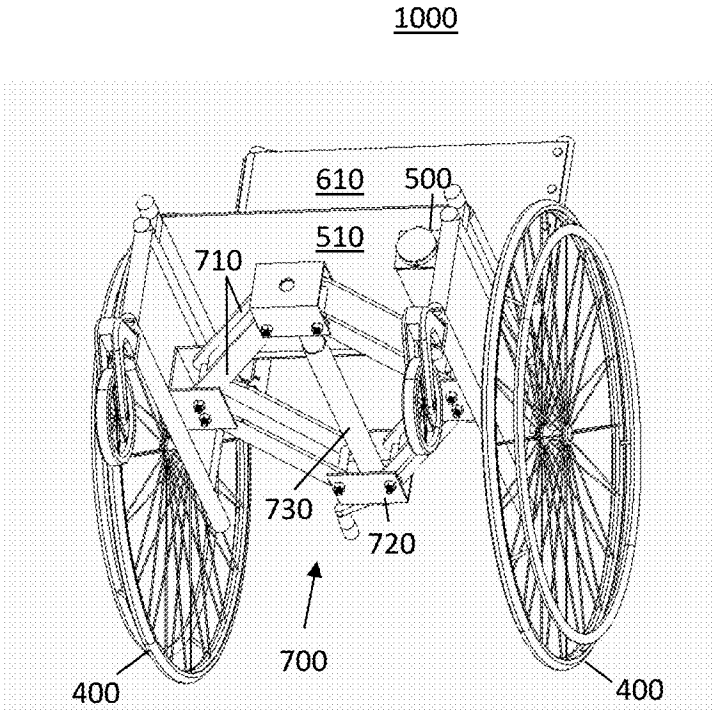
FIG. 4 is a perspective view, partially from below the front an embodiment of an adjustable wheelchair according to the current invention.

FIG. 4 is a perspective view, partially from below the front an embodiment of an adjustable wheelchair according to the current invention.

Figure 5:
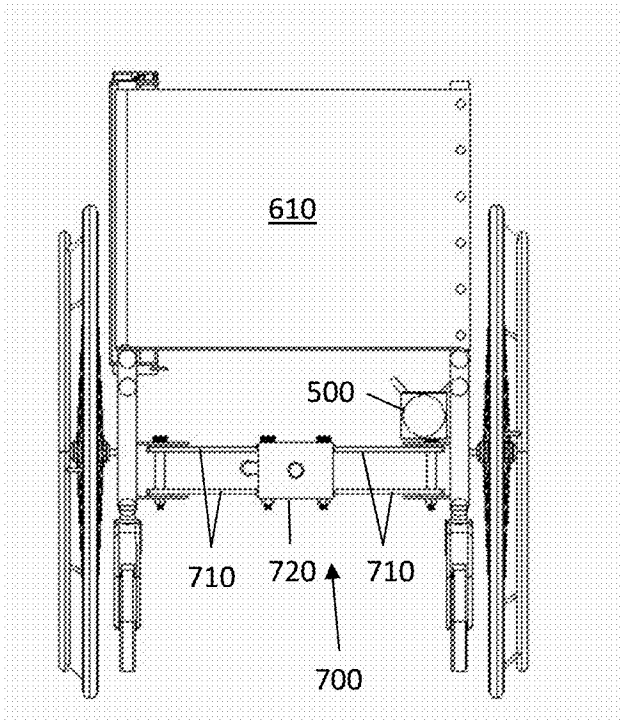
FIG. 5 is a front elevational view of the adjustable wheelchair of FIG. 1.

FIG. 5 is a front elevational view of the adjustable wheelchair of FIG. 1.

Figure 6:
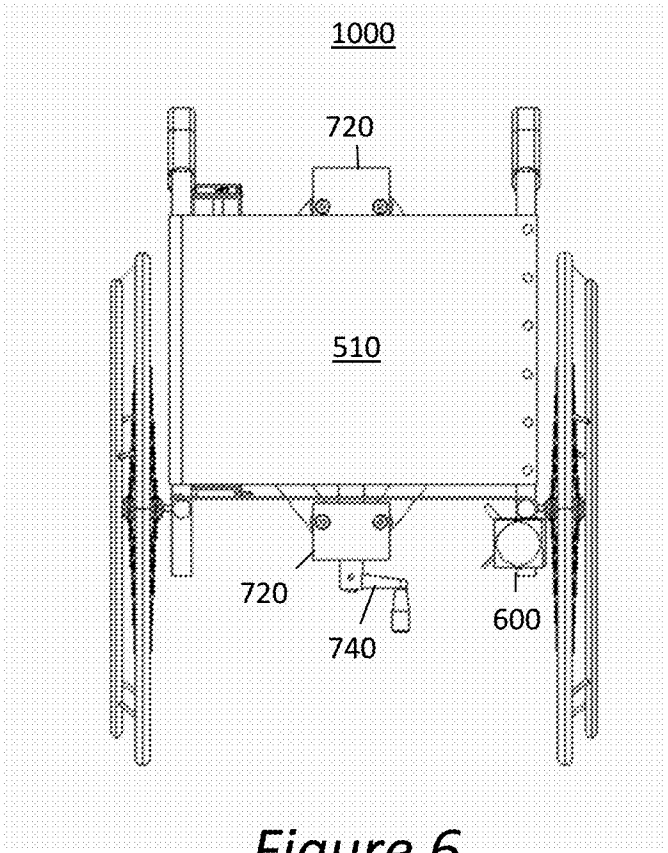
FIG. 6 is a plan view of the adjustable wheelchair of FIG. 1.

FIG. 6 is a plan view of the adjustable wheelchair of FIG. 1.

The adjustable wheelchair 1000 is comprised of two side frames 100 which support the rear wheels 400 and the front wheel assemblies 300. The side frames 100 each include a horizontal lower support 150 and a horizontal upper support 160 which both connect to a substantially vertical front frame support 110.

Front wheel assembly 300 consists of a pivot 310 which connects the front frame support 110 to a front wheel carrier 320 that carries the front wheel 330.

A seat cartridge 500 and a back cartridge 600 unroll seat material 510 and back material 610 which act as a seat and back, respectively for the user. The cartridges 500 and 600 are spring-loaded to roll up the seat material 510 and back material 610, but include a rotation stop (540 of FIG. 18) to stop the unrolling of the material from the cartridges. The seat cartridge 500 is removable and replaceable. To correctly match a seat material to a user, the length from back to front of the seat material should be slightly shorter than the length of the user's thigh. If it is too long, the user will experience the seat digging into the underside of his/her knees. If the seat material is too short, there is a lack of support and the user feels as if he/she is falling out of the chair. This problem is usually felt by younger, smaller users that cannot articulate the problem, so many are not aware of the problem.

Therefore, the current design has replaceable seat cartridges which allow the current seat cartridge to be removed, and the seat cartridge with the proper length of seat material to be used.

This is also the case with the replaceable back cartridge 600. A properly sized back cartridge may be used which matches the size of the user.

A diamond shaped frame, or "diamond frame" 700 is easily seen in FIG. 4. The diamond frame connects the two side frames 100. The diamond frame 700 is designed to have an adjustable width, but is also allowed to be easily folded for storage.

The front corner connector 720 can be seen. In this embodiment, two upper diagonal members 710 are pivotally attached to the corner connector 720 as well as two lower diagonal members 710. This reduces flexing along a vertical line and provides increased stability to the structure as compared with single support structures. The front of the seat cartridge 500 is seen above the diagonal frame.

A crank 740 is shown that connects to a threaded rod (735 of FIG. 13) through rear corner connector 720. Turning the threaded rod adjusts the width of the adjustable wheelchair 1000.

Figure 7:
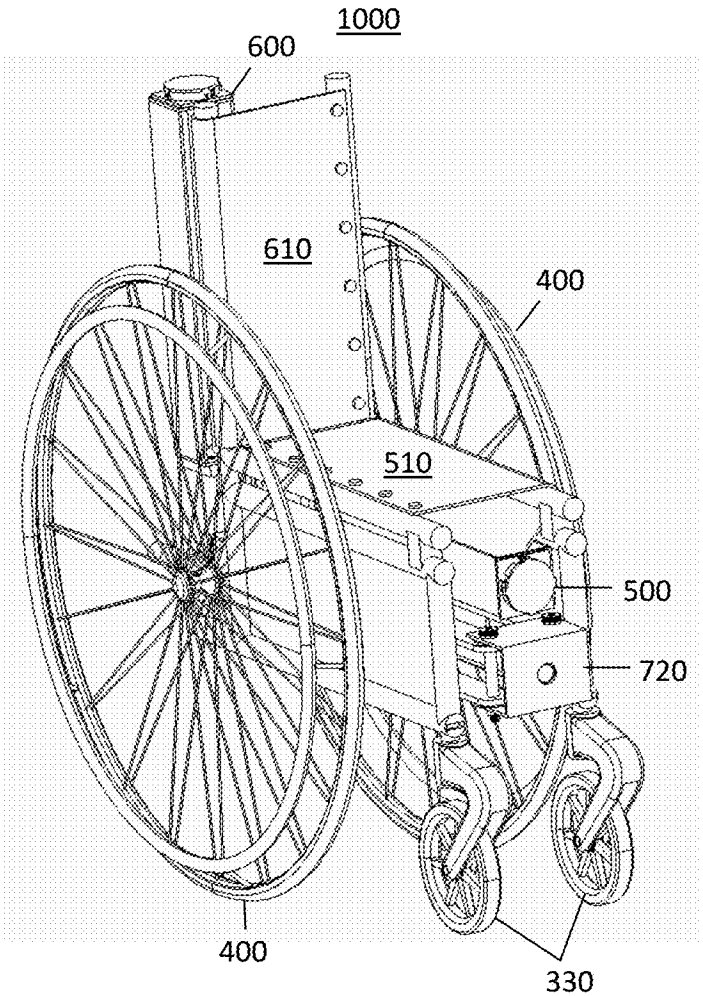
FIG. 7 is a perspective view, partially from the front, of the adjustable wheelchair of FIG. 1 in its folded position.

FIG. 7 is a perspective view, partially from the front, of the adjustable wheelchair of FIG. 1 in its folded position. As can be seen, the back material 610 and seat material 510 have been wound into their respective cartridges 500 and 600. The wheelchair collapses down to approximately the width of the corner connector 720 of the diamond frame.

Figure 8:
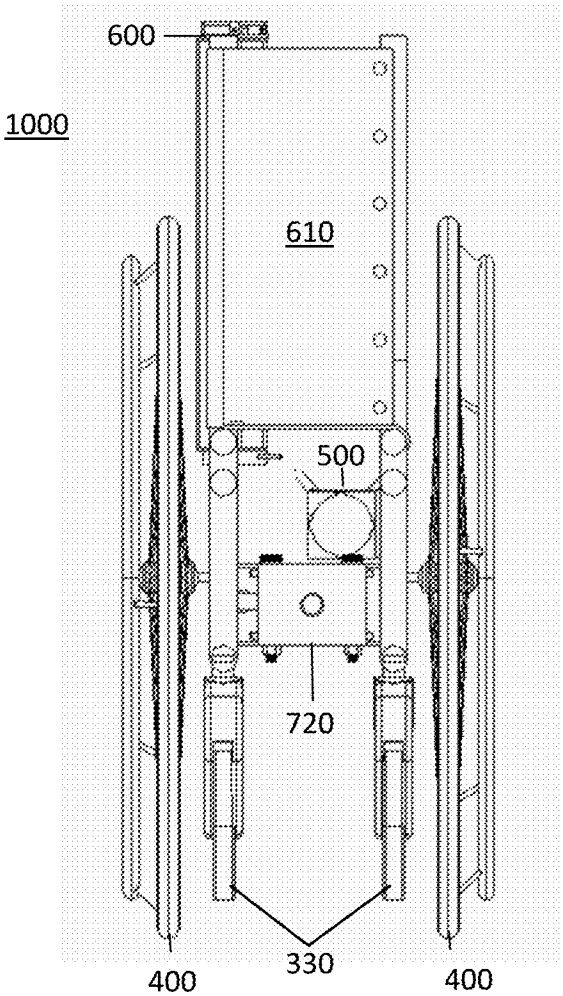
FIG. 8 is a front elevational view of the adjustable wheelchair of FIG. 1 in its folded position.

FIG. 8 is a front elevational view of the adjustable wheelchair of FIG. 1 in its folded position. Here it can be seen that the back material 610 has been rolled into the cartridge 600.

Figure 9:
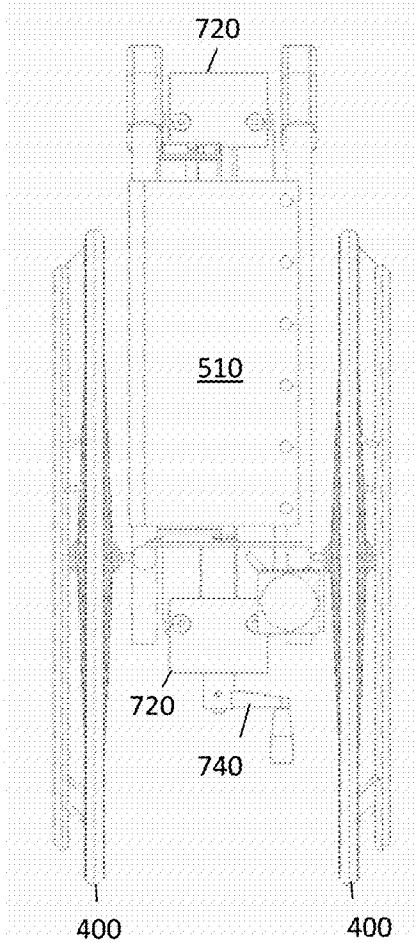
FIG. 9 is a plan view of the adjustable wheelchair of FIG. 1 in its folded position.

FIG. 9 is a plan view of the adjustable wheelchair of FIG. 1 in its folded position. In this view, it can be seen that the seat material 510 has been pulled into the seat cartridge and is considerably narrower. The front corner connector 720 is shown at the top of the figure and the rear corner connector 720 is shown at the bottom of the figure. The crank 740 used for adjustment of the width is shown near the bottom of the figure.

Figure 10:
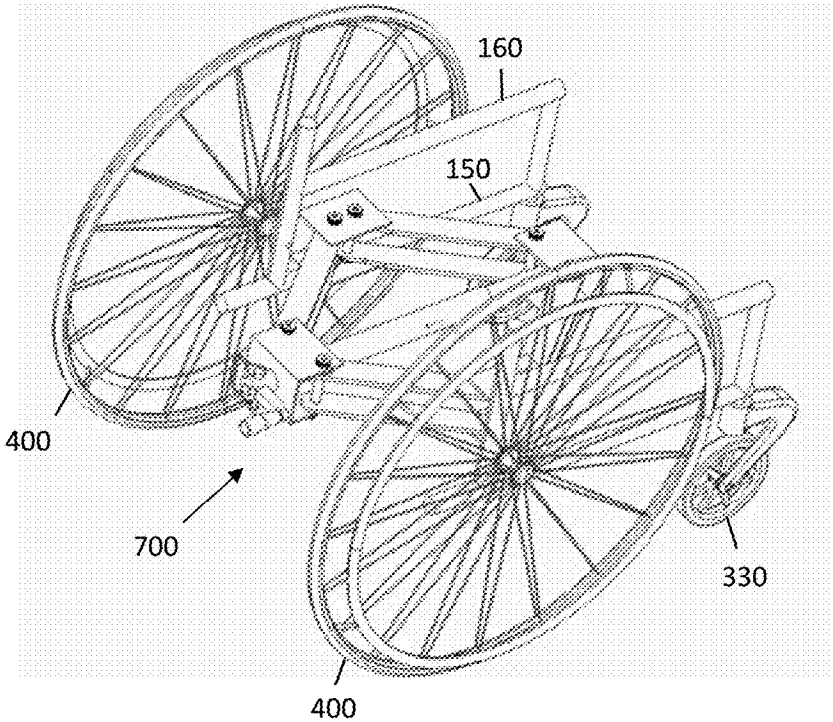
FIG. 10 is a perspective view of a partially assembled adjustable wheelchair of FIG. 1.
Figure 11:
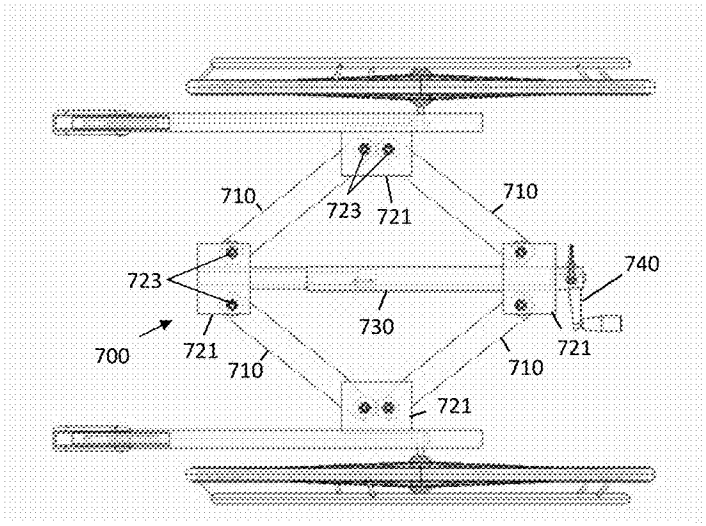
FIG. 11 is a plan view of the partially assembled adjustable wheelchair of FIG. 1 showing the diamond frame.
Figure 12:
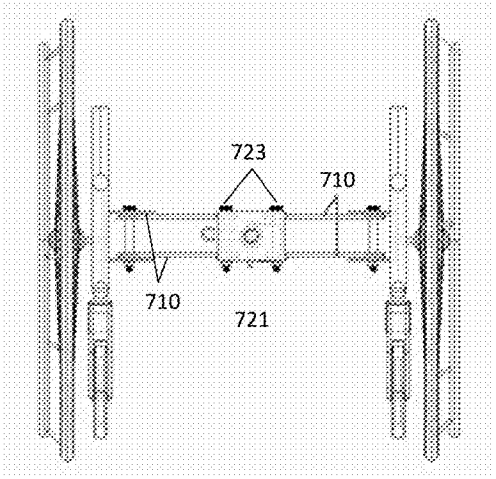
FIG. 12 is a front elevational view of the partially assembled adjustable wheelchair of FIG. 1.

FIG. 10 is a perspective view of a partially assembled adjustable wheelchair of FIG. 1. In FIGS. 10, 11 and 12 most of the structures above the diamond frame 700 are removed for clarity.

FIG. 11 is a plan view of the partially assembled adjustable wheelchair of FIG. 1 showing the diamond frame 700. This embodiment somewhat resembles a scissors jack used to lift cars and other heavy vehicles. Since this is being used to extend the width of the frame, and there is little or no force in the horizontal direction. However, it must support the weight of a patient in the vertical direction. Therefore, the forces acting on it are much different form a floor jack, and the design is different.

The center extension piece 730 is visible. The center extension piece 730 controls the pre-selected width adjustment, and also allows folding of the frame. Pivots 723 are employed between the diagonal members 710 and corner pieces 721 allowing the diagonal members 710 to change orientation relative to the corner pieces 721.

Figure 13:
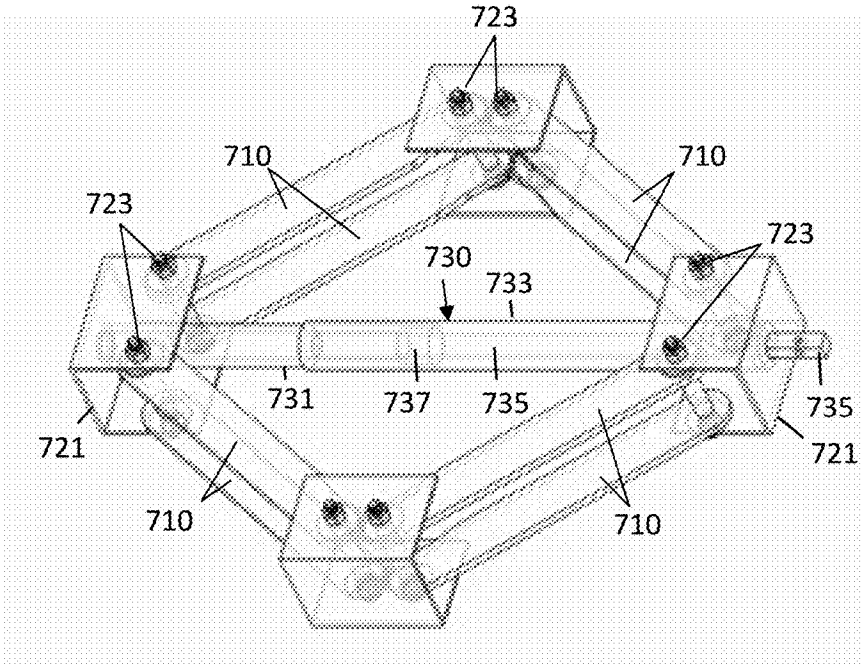
FIG. 13 is a perspective view of a diamond frame consistent with one embodiment of the current invention.

FIG. 12 is a front elevational view of the partially assembled adjustable wheelchair of FIG. 1. Here the lower half of the adjustable wheelchair is shown. This shows upper and lower diagonal pieces 710 and pivots 723 of the diamond frame FIG. 13 is a perspective view of a diamond frame consistent with one embodiment of the current invention. Parts of the center extension piece 730 are shown here. A threaded rod 735 fits through the center extension piece 730. An inner tube 731 is allowed to freely slide inside of outer tube 733. A stop 737 is keyed or otherwise modified to prevent rotation relative to the outer tube 733 and can screw up or down the threaded rod 735 as the threaded rod is rotated. The inner tube 731 is free to slide into the outer tube 733 until it encounters the stop 737. As the sides of the diamond frame are pressed inward, the inner tube 731 is allowed to be extracted from the outer tube 733. This allows the frame to be in the completely folded position as show in FIGS. 7-9. However, when the inner tube 731 is inserted into outer tube 733, it can only be inserted until it hits the stop 737. This will be at the previously pre-adjusted width. Therefore, the adjustable wheelchair can be fully folded, then later opened to a pre-adjusted width without the need to make any additional adjustments.

Figure 14:
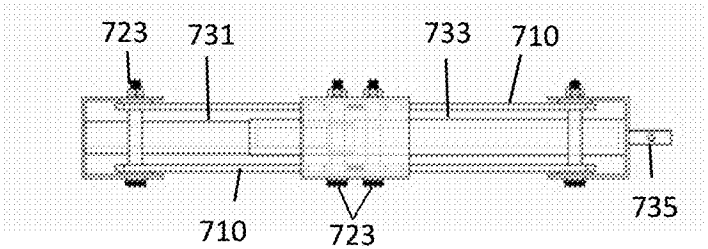
FIG. 14 is a side elevational view of a diamond frame according to one embodiment of the current invention

FIG. 14 is a side elevational view of a diamond frame according to one embodiment of the current invention. Here the relative positions of the inner tube 731, outer tube 733, threaded rod 735, and diagonal members 710 can be seen from a side perspective.

Figure 15:
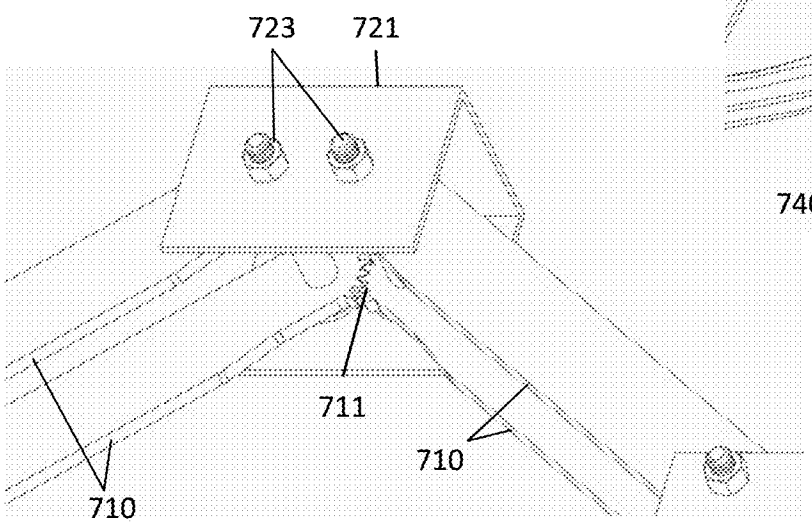
FIG. 15 is a perspective view of interleaved teeth of two diagonal members of a diamond frame according to one embodiment of the current invention.

FIG. 15 is a perspective view of interleaved teeth of two diagonal members of a diamond frame according to one embodiment of the current invention. It was found that if the end of the diagonal members 710 was cut with teeth 711 which interleaved with teeth 711 of another diagonal member 710 interfacing with it at the corner connector 720, it results in a more rigid frame. This design was implemented in the current invention to result in a stronger design.

Figure 16:
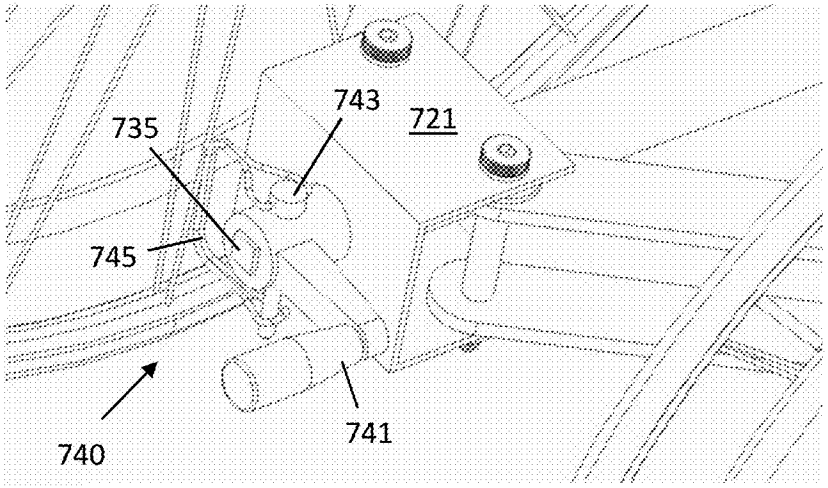
FIG. 16 is a perspective view of a rear corner connector of a diamond frame according to one embodiment of the current invention.

FIG. 16 is a perspective view of a rear corner connector of a diamond frame according to one embodiment of the current invention. In this embodiment, the crank 740 is comprised of a crank handle 741 which fits over an end of the threaded rod 735 and turns the threaded rod 735 when the crank handle 741 is turned. In this embodiment, the handle 741 is removable. It has a pin 743 which fits through the handle 741 and threaded rod 735. A clip 745 clips onto the pin 743 holding it in place.

Figure 17:
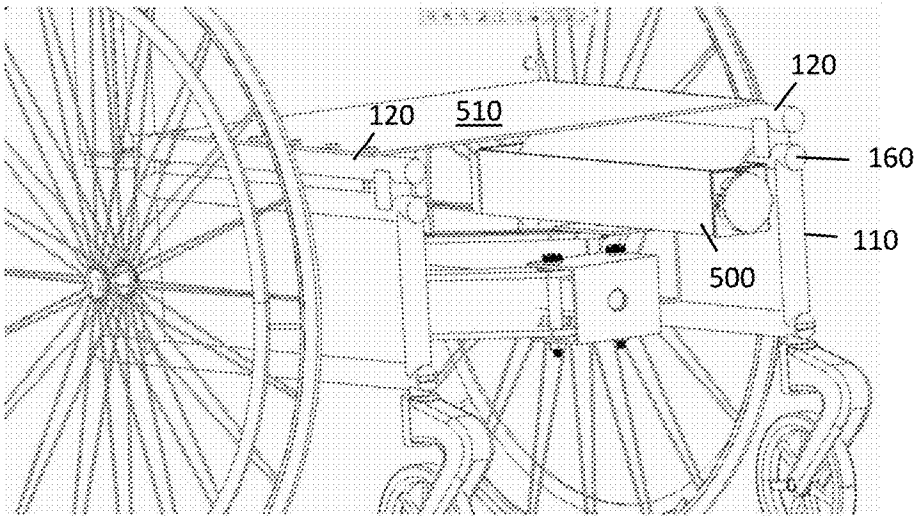
FIG. 17 is a perspective view of a seat cartridge with seat material extended to span between two seat supports according to one embodiment of the current invention.

FIG. 17 is a perspective view of a seat cartridge 500 with seat material 510 extended to span between two seat supports 120 according to one embodiment of the current invention. The seat material 510 is attached to the left seat support 120.

Figure 18:
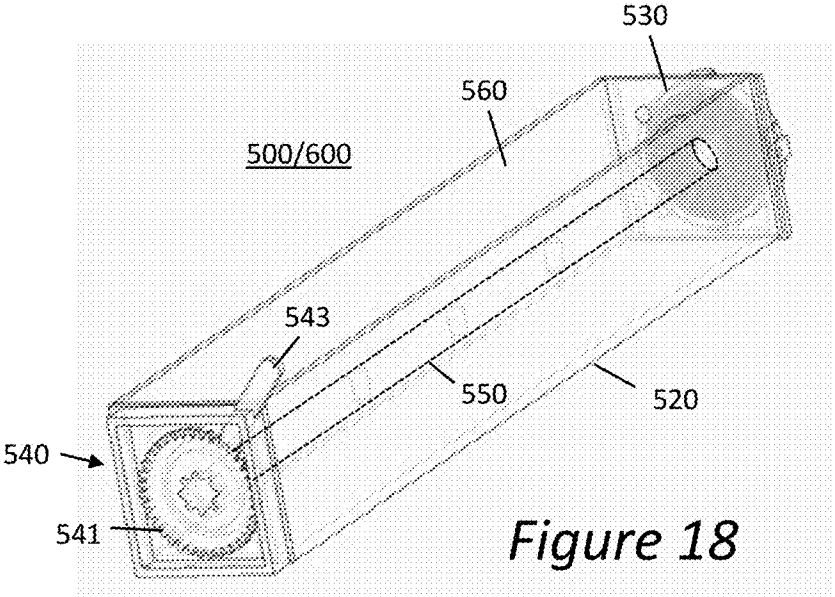
FIG. 18 is a perspective view of a cartridge which may be either a seat cartridge or a back cartridge showing a rotation stop mechanism according to one embodiment of the current invention.

FIG. 18 is a perspective view of a cartridge which may be either a seat cartridge 500 or a back cartridge 600 showing a rotation stop mechanism 540 according to one embodiment of the current invention. The seat or back material 510/610 is wrapped around the carrier rod 550. A cartridge spring mechanism 530 biases the carrier rod 550 to rotate in a direction to wind in the material. There is a cartridge housing 520 with an opening 560 at the top where the seat/back material 510/610 exits the cartridge 500/600.

Figure 19:
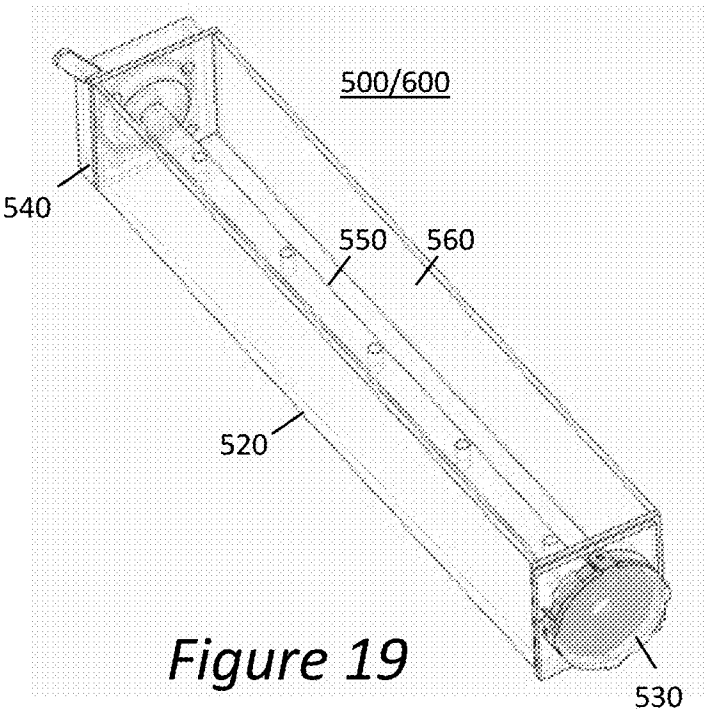
FIG. 19 is a perspective view of a cartridge which may be either a seat cartridge or a back cartridge showing a spring return mechanism according to one embodiment of the current invention.

FIG. 19 is a perspective view of a cartridge which may be either a seat cartridge 500 or a back cartridge 600, showing a cartridge spring mechanism 530 according to one embodiment of the current invention. This cartridge spring mechanism 530 biases the carrier rod 550 to reel in the back or seat material 510/610.

Figure 20:
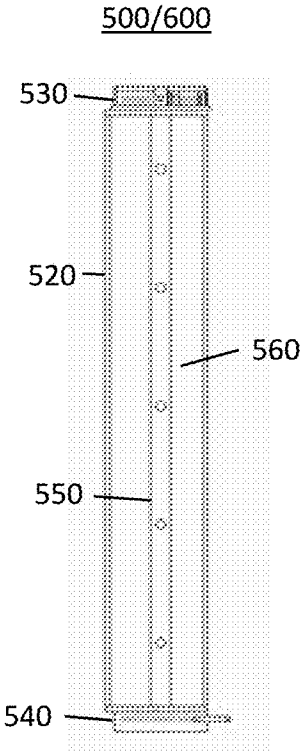
FIG. 20 is a plan view of a cartridge which may be either a seat cartridge or a back cartridge according to one embodiment of the current invention.

FIG. 20 is a plan view of a cartridge which may be either a seat cartridge 500 or a back cartridge 600, according to one embodiment of the current invention. In this view, both the cartridge spring mechanism 530 and the rotation stop mechanism 540 are visible.

Figure 21:
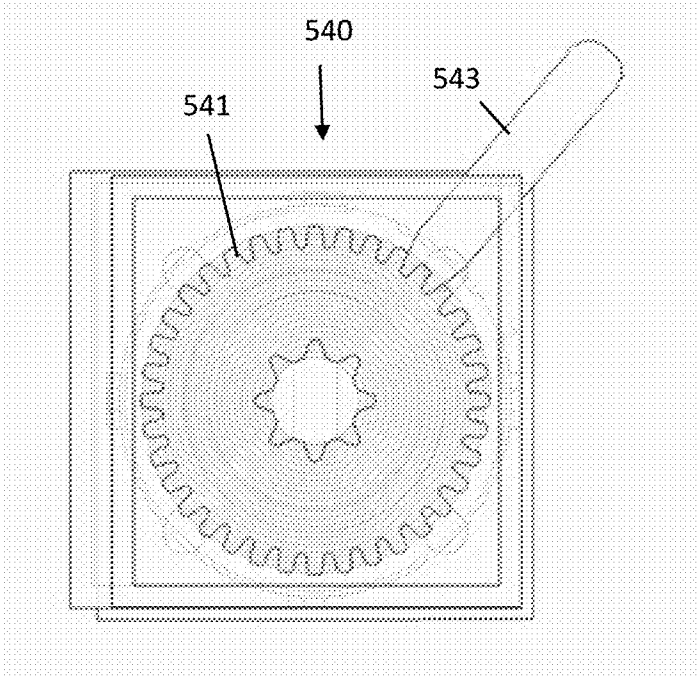
FIG. 21 is an illustration of a rotation stop mechanism according to one embodiment of the current invention.

FIG. 21 is an illustration of a rotation stop mechanism 540 according to one embodiment of the current invention. A latch is positioned to jam the gear 541 in order to stop the gear 541 from turning. This must be resilient enough to hold the weight of the user when the user sits on the seat material 510.

Figure 22:
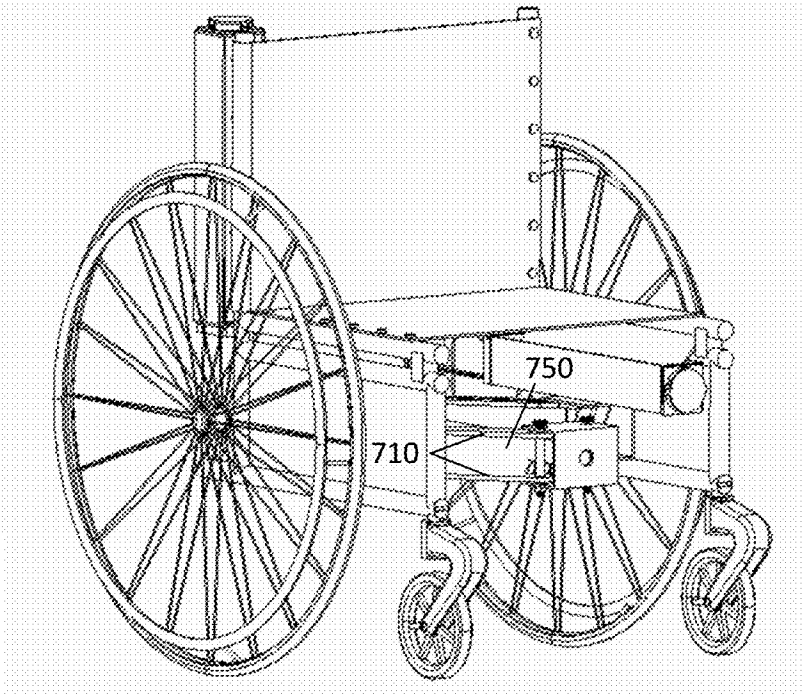
FIG. 22 is a perspective view of an adjustable wheelchair showing structural enhancements of the diamond frame according to one embodiment of the current invention.

FIG. 22 is a perspective view of an adjustable wheelchair showing structural enhancements of the diamond frame according to one embodiment of the current invention.

Figure 23:
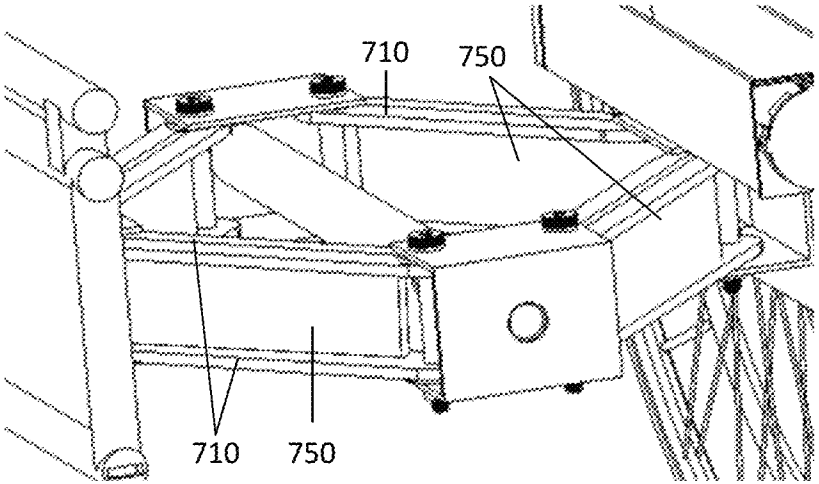
FIG. 23 shows a perspective view showing the diamond frame with structural enhancements according to one embodiment of the current invention.

FIG. 23 shows a perspective view showing the diamond frame with structural enhancements according to one embodiment of the current invention. This embodiment will be described in connection with FIGS. 22 and 23.

As the user grows, the wheelchair adjusts to his/her increased size, as indicated above. However, the user also increases in weight. In many cases this weight can double. If the wheelchair was designed to carry the increased weight, it would have to be structurally much stronger with thicker structural members. This would cause increased weight. Therefore, there would be unnecessary weight which would be continuously lifted and carried for years. In this embodiment, the wheelchair is designed to carry the current weight of the user (and a small additional weight, for safety). As the user grows, additional members, such as support members 750 are added to critical stress points, such as the diagonal members 710 of the diamond frame 700. In this embodiment, the support members 750 are flat plates mounted between the diagonal members 710. Since this adjustment is contemplated when the wheelchair was manufactured, it is made with attachment points (devices) on the diagonal members 710 or other location which the support members are intended to attach. These may be bolt holes, sockets, threaded recesses, screw holes, or any other commonly known means of attachment. The support members 750 may be flat plates bolted flat against one or more of the diagonal members 710.

Similarly, for bariatric users and other uses which reduce their weight considerably, the wheelchair could have the support members 750 attached, and as the user reduces weight, the support members may be removed.

In still other embodiments, the support members 750 may have a semi-circular cross section and support one or both sides of a support member with a round cross section.

In still another alternative embodiment, the support member 750 may be tubular shaped and fit over a round support member. This may require some disassembly of the wheelchair to apply these support members 750.

The support members may also have square or rectangular cross sections and fit over members having similar cross-sections.

The support members 750 may be made of various strengths and/or thicknesses and weights so that these may be changed regularly as the user grows or reduces weight. This allows for a continuous change in strength and weight as the user changes weight.

Therefore, a novel adjustable wheelchair is disclosed that expands in size and strength as the user grows, or can be reduced in size and strength (weight) as the user reduces his/her size and mass.

While the invention has been described in conjunction with specific embodiments, it is evident that many alternatives, modifications and variations will be apparent to those skilled in the art. Accordingly, the preferred embodiments of the invention, as set forth herein, are intended to be illustrative, not limiting. Various changes may be made without departing from the true spirit and full scope of the invention, as defined in the following claims.

What is claimed is:

1. An adjustable wheelchair comprising:

a. a first side frame supporting at least one wheel;

b. a second side frame supporting at least one wheel;

c. a foldable mechanism connecting the first side frame to the second side frame, the foldable mechanism comprising:

a center extension piece having an inner tube that is free to slide into an outer tube until it encounters a stop continuously adjustably-positioned along the length of the outer tube, making it continuously adjustable which can be placed in one of a collapsed position in which it has minimal width and an open position in which it opens to a pre-adjusted width.

2. The adjustable wheelchair of claim 1 further comprising:

an adjustable back support which can be placed in one of a collapsed position in which it has minimal width and an open position in which it opens to the pre-adjusted width.

3. The adjustable wheelchair of claim 1 further comprising:

an adjustable seat which can be placed in one of a collapsed position in which it has minimal width and an open position in which it opens to the pre-adjusted width.

4. The adjustable wheelchair of claim 1 further comprising:

a plurality of reinforcement structures which removeably attach to the foldable mechanism reinforcing the foldable mechanism.

5. The adjustable wheelchair of claim 1 further comprising:

a plurality of reinforcement structures which attach to at least one of the side frames reinforcing the side frame.

6. The adjustable wheelchair of claim 3, wherein the adjustable seat comprises:

a. a roller attached to the first side frame such that the roller can rotate;

b. seat material wound around the roller having a free end attached to the second side frame;

c. a spring biasing the roller to rotate in a direction to roll in the free end of the seat material; and d. a stop on the roller which stops rotation of the roller.

7. The adjustable wheelchair of claim 2, wherein the adjustable back support comprises:

a. a roller attached to the first side frame such that the roller can rotate;

b. back support material wound around the roller having a free end attached to the second side frame;

c. a spring biasing the roller to rotate in a direction to roll in the free end of the back support material; and d. a stop on the roller which stops rotation of the roller.

8. The adjustable wheelchair of claim 1 wherein the foldable mechanism is a diamond shape having:

a. a front corner connector, b. a rear corner connector;

c. two side corner connectors;

d. diagonal members pivotally connected between the front corner connector and the side corner connectors;

e. diagonal members pivotally connected between the rear corner connector and the side corner connectors;

f. the center extension piece connected between the front and rear corner connectors that can adjust the distance between the front and rear corner connectors thereby changing the distance between the side corner connectors.

9. An adjustable wheelchair comprising:

a. a first side frame supporting at least one wheel;

b. a second side frame supporting at least one wheel;

c. a foldable mechanism connecting the first side frame to the second side frame, which is continuously adjustable which can be placed in one of a collapsed position in which it has minimal width and an open position in which it opens to a pre-adjusted width;

d. attachment devices on the foldable mechanism;

e. removable reinforcement members of various strengths adapted to attach to the attachment devices to adjust the structural strength of the wheelchair to a user's current weight as the user changes weight.

10. The adjustable wheelchair of claim 9 further comprising:

a back support which can be placed in one of a collapsed position in which it has minimal width and an open position in which it opens to the pre-adjusted width.

11. The adjustable wheelchair of claim 9 further comprising:

a seat support which can be placed in one of a collapsed position in which it has minimal width and an open position in which it opens to the pre-adjusted width.

12. The adjustable wheelchair of claim 11, wherein the seat support comprises:

a. a roller attached to the first side frame such that the roller can rotate;

b. seat material wound around the roller having a free end attached to the second side frame;

c. a spring biasing the roller to rotate in a direction to roll in the free end of the seat material; and d. a stop on the roller which stops rotation of the roller.

13. The adjustable wheelchair of claim 10, wherein the back support comprises:

a. a roller attached to the first side frame such that the roller can rotate;

b. back support material wound around the roller having a free end attached to the second side frame;

c. a spring biasing the roller to rotate in a direction to roll in the free end of the back support material; and d. a stop on the roller which stops rotation of the roller.

* * * * *